US008807790B2

(12) United States Patent
Cho et al.

(10) Patent No.: US 8,807,790 B2
(45) Date of Patent: Aug. 19, 2014

(54) LIGHTING APPARATUS

(75) Inventors: Hankyu Cho, Seoul (KR); Jaehwan Kim, Seoul (KR); Donki Paik, Seoul (KR)

(73) Assignee: LG Electronics Inc., Seoul (KR)

( * ) Notice: Subject to any disclaimer, the term of this patent is extended or adjusted under 35 U.S.C. 154(b) by 183 days.

(21) Appl. No.: 13/451,765

(22) Filed: Apr. 20, 2012

(65) Prior Publication Data

US 2013/0058083 A1 Mar. 7, 2013

(30) Foreign Application Priority Data

Sep. 5, 2011 (KR) ..... 10-2011-0089474

(51) Int. Cl.
*F21V 1/00* (2006.01)

(52) U.S. Cl.
USPC . 362/235; 362/249.02; 362/294; 362/296.01; 362/310

(58) Field of Classification Search
USPC ..... 362/234, 235, 249.01, 249.02, 253, 362/294, 296.01, 310, 341, 345, 346, 373, 362/800
See application file for complete search history.

(56) References Cited

U.S. PATENT DOCUMENTS

2011/0090686 A1* 4/2011 Pickard ..... 362/235
2011/0215696 A1* 9/2011 Tong et al. ..... 313/46

FOREIGN PATENT DOCUMENTS

KR 10-2010-0037353 A 4/2010
KR 10-2010-0037354 4/2010

* cited by examiner

*Primary Examiner* — Meghan Dunwiddie
(74) *Attorney, Agent, or Firm* — KED & Associates, LLP

(57) ABSTRACT

A lighting apparatus is disclosed herein that may omni-directionally radiate light emitted from a light emitting diode (LED). The lighting apparatus may include a heat sink and a mounting block provided over the heat sink. A light emitting module may be provided on a side surface of the mounting block. A reflector may be provided over the heat sink, adjacent to a lower end of the mounting block, to reflect light from the LED. An enclosure may be provided over the heat sink to surround the mounting block to diffuse the light. The light axis of the LED may be directed to a side region of the bulb and the reflector may include an inclined surface that is inclined at a second prescribed angle away from the light axis to distribute the light in an omni-directional angular region.

20 Claims, 6 Drawing Sheets

LIGHTING APPARATUS

CROSS-REFERENCE TO RELATED APPLICATION(S)

This application claims priority under 35 U.S.C. §119 to Korean Application No. 10-2011-0089474 filed in Korea on Sep. 5, 2011, whose entire disclosure is hereby incorporated by reference.

BACKGROUND

1. Field

A lighting apparatus is disclosed herein.

2. Background

Lighting apparatuses are known. However, they suffer from various disadvantages.

BRIEF DESCRIPTION OF THE DRAWINGS

The embodiments will be described in detail with reference to the following drawings in which like reference numerals refer to like elements wherein.

DETAILED DESCRIPTION

Figure 1:
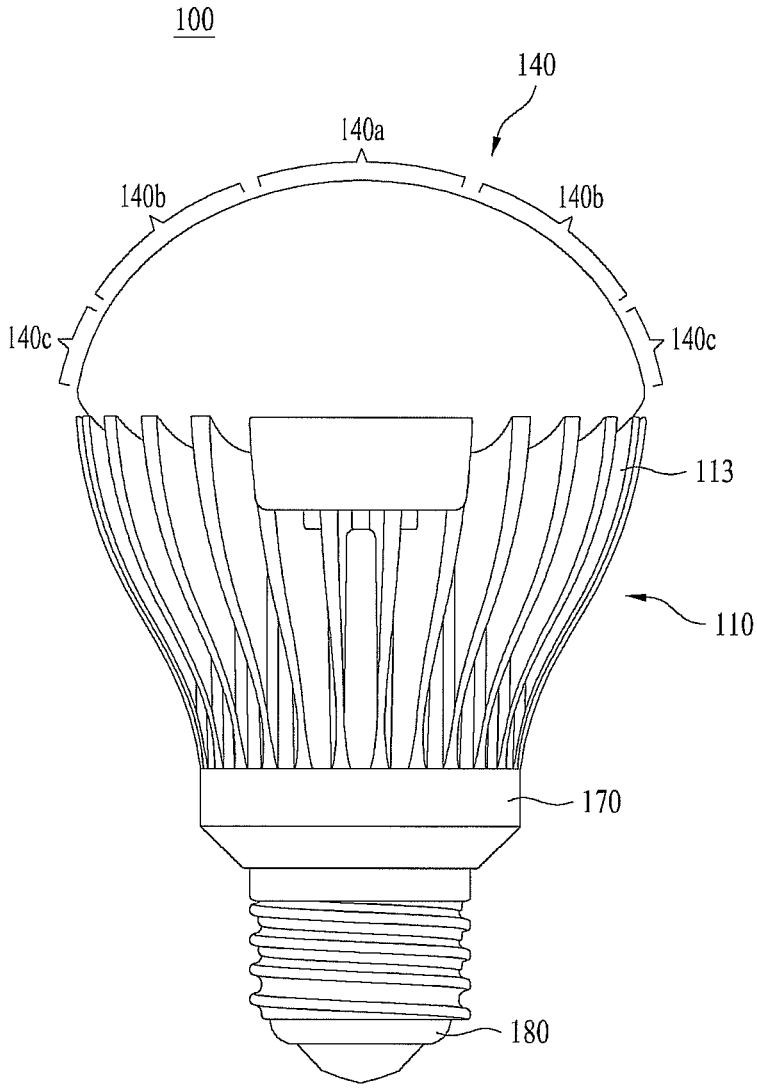
FIG. 1 is a perspective view of a lighting apparatus according to an embodiment of the present disclosure.

Lighting apparatuses may include incandescent bulbs, fluorescent lamps and discharge lamps. These lighting apparatuses may be used for a variety of purposes, such as domestic, industrial, and outdoor purposes. However, lighting apparatuses operating based upon electrical resistance, such as incandescent bulbs, etc., have problems of low efficiency and high heat loss. Discharge lamps are expensive and exhibit relatively poor energy efficiency and fluorescent lamps may be harmful to the environment due to use of mercury.

In contrast, lighting apparatuses which use light emitting diodes (LEDs) may avoid these disadvantages while providing many benefits, such as higher efficiency as well as flexibility in the design of the lighting apparatus (e.g., colors and designs). An LED is a semiconductor device which emits light when a forward voltage is applied thereto. Such an LED exhibits relatively longer lifespans, lower power consumption, and electrical, optical, and physical characteristics suitable for mass production.

However, LEDs generate relatively large amounts of heat. This heat may degrade performance of the lighting apparatus if such heat is not sufficiently dissipated through a heat sink, or the like. Moreover, if the heat generated from the LED is transferred to other constituent elements via the heat sink, the constituent elements may overheat or be damaged. The heat may also deform or otherwise damage the bulb if not sufficiently dissipated and allowed to transfer to the bulb.

Furthermore, LEDs may exhibit degraded light distribution characteristics because of a relatively narrow angular range of light emission, and hence, may not effectively illuminate a large area. For example, a lighting apparatus which employs LEDs may exhibit a high degree of directionality and a narrow radiation angle. For this reason, when an LED based lighting apparatus is installed on a ceiling, for example, only a relatively small region disposed directly beneath the lighting apparatus may be illuminated with sufficient intensity, and areas which are farther away from the light source may not be illuminated with sufficient intensity. Therefore, in order to illuminate a large area with a sufficient intensity of illumination, it may be necessary to increase the number of lighting apparatuses, at the expense of costs in materials and installation.

Accordingly, the present disclosure is directed to a lighting apparatus that substantially obviates one or more problems due to these limitations and disadvantages. As embodied and broadly described herein, a lighting apparatus may be capable of omni-directionally radiating light emitted from an LED while maintaining a uniform level of light intensity. The lighting apparatus may be capable of illuminating a wider area using light emitted from a light emitting diode (LED). The lighting apparatus may reduce the amount of heat transferred from a heat sink to a bulb. Moreover, the lighting apparatus as disclosed herein may allow a reduction in the number of constituent elements, a reduction in manufacturing costs, and be suitable for mass production.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

Reference will now be made in detail to the embodiments of the present disclosure associated with a lighting apparatus, examples of which are illustrated in the accompanying drawings. The accompanying drawings illustrate exemplary embodiments of the present disclosure and provide a more detailed description of the present disclosure. However, the scope of the present disclosure should not be limited thereto.

In addition, wherever possible, the same reference numbers will be used throughout the drawings to refer to the same or like parts, and a repeated description thereof will be omitted. For clarity, dimensions and shapes of respective constituent members illustrated in the drawings may be exaggerated or reduced. Moreover, although terms including an ordinal number, such as first or second, may be used to describe a variety of constituent elements, the constituent elements are not limited to the terms, and the terms are used only for the purpose of discriminating one constituent element from other constituent elements.

Figure 2:
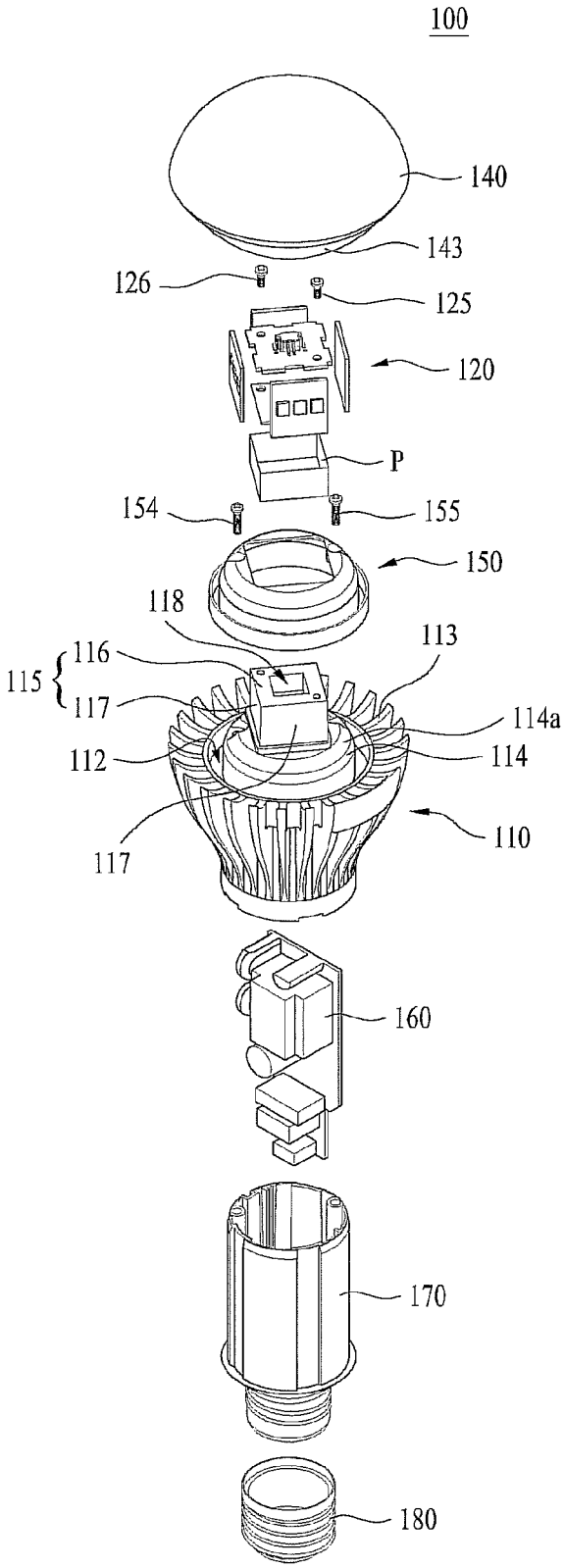
FIG. 2 is an exploded perspective view of the lighting apparatus of FIG. 1.
Figure 3:
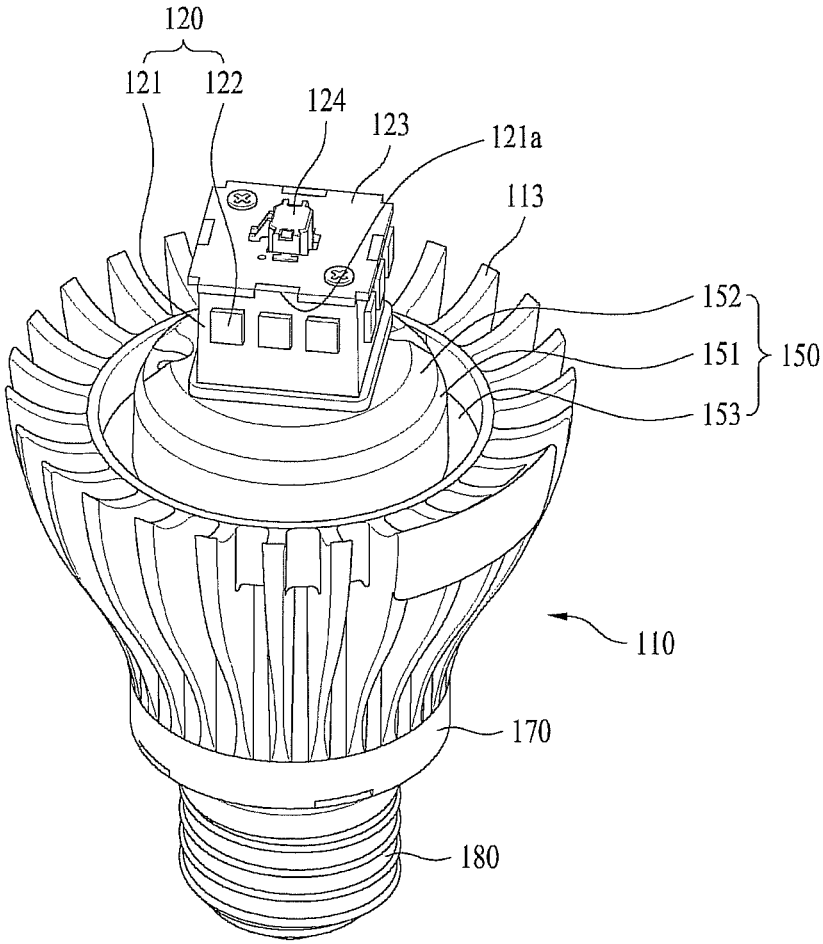
FIG. 3 is another perspective view of the lighting apparatus of FIG. 1.

FIG. 1 is a perspective view of a lighting apparatus according to one embodiment of the present disclosure. FIG. 2 is an exploded perspective view of the lighting apparatus of FIG. 1. FIG. 3 is another perspective view of the lighting apparatus of FIG. 2. The lighting apparatus 100 may include a light emitting module 120, a heat sink 110 provided with a mounting block 115, an enclosure 140, and a reflection member 150 (reflector). The enclosure 140 may be a bulb or another appropriate type of enclosure.

In one embodiment, the lighting apparatus may include a second reflection member (upper reflector) provided over the mounting block to redirect a portion of the light toward the lower regions of the lighting apparatus. Examples of lighting apparatuses that include an upper reflector are disclosed in U.S. Pat. application Ser. No. 13/421,243 , which is hereby incorporated by reference.

The lighting apparatus 100 may include an electronic module 160 (or power module), a power socket 180, and a housing 170. The outer shape and dimensions of the lighting apparatus 100 may correspond to a shape and dimension of various types of standard lamps, such as the incandescent bulbs.

The mounting block 115, which may be provided on the heat sink 110, may have a top surface 116 and a plurality of side surfaces 117. The mounting block 115 may be formed to be integral to the heat sink 110. For example, the heat sink 110 may be cast or molded to include the mounting block 115 as a single structure. The bulb 140 may be disposed on the heat sink 110 such that it surrounds the mounting block 115.

The light emitting module 120 may be an LED module that includes one or more LEDs. The light emitting module 120 may include a first substrate 121 mounted to one side surface 117 of the mounting block 115 and at least one LED 122 mounted on the first substrate 121 to radiate light toward a side region 140*b* of the bulb 140. A lens 130 may be provided over the LED on the substrate to improve light distribution characteristics The reflector 150 may be arranged on the heat sink 110. The reflector 150 may have an inclined surface 152, which is downwardly inclined from the side surfaces 117 of the mounting block 115 toward the heat sink 110. The position of the reflector 150 as well as the angle of the inclined surface 152 prevents the reflector 150 from interfering with light emitted from the LED 122 at a predetermined light distribution angle of the lighting apparatus 100.

The enclosure 140 may be a bulb of various shapes and sizes, taking into consideration the design of the lighting apparatus 1. The bulb 140 may have a function of diffusing light emitted from the light emitting module 120 or adjusting a direction of light radiated from the bulb 140. For example, where the bulb 140 functions as a diffusion member (diffuser), it may scatter or diffuse light to reduce or eliminate the directionality of light. In this case, the bulb 140 may also have a prescribed surface structure (e.g., patterned surface to scatter or diffuse light) over the entire surface thereof.

The bulb 140 may be divided into the central region 140*a*, which corresponds to a central axis C (central vertical axis) of the heat sink 110, the side region 140*b*, which extends from the central region 140*a*, and a lower end region 140*c* arranged adjacent to the heat sink 110. The central region 140*a*, side region 140*b*, and lower end region 140*c* may have different curvatures (in both vertical and horizontal directions) and may be formed of different types of materials having different optical and/or thermal characteristics. For example, the central region 140*a* and the side region 140*b* may form a dome shape which the lower end region 140*c* may have a cone shape, e.g., a vertically linear slope.

A mounting end 143 may be provided at the lower end region 140*c* of the bulb 140. The mounting end 143 may have a ring shape. The mounting end 143 may be a single circular flange or a plurality of protrusions, such as tabs. The mounting end 143 may also include a ridged portion (or hook) to mate with a corresponding notch or the like. The mounting end 143 may be formed of a thermally insulating material to prevent heat transfer from the heat sink 110 to the bulb 140.

The electronic module 160 (power module) is electrically connected to the light emitting module 120. The housing 170 accommodates the electronic module 160. The power socket 180 is mounted to the housing 170, and is electrically connected to the electronic module 160.

The electronic module 160 is disposed within the housing 170. The electronic module 160 functions to convert external power (e.g., commercial power) into input power compatible with the light emitting module 120. The housing 170 may thermally and electrically insulate the power module 160 from the heat sink 110. The power socket 180, which supplies commercial power, may be mounted to the housing 170. The space or gap in the housing 170 between the inner surfaces of the housing 170 and the electronic module 160 may be filled with an insulating material, such as insulating foam, film, or the like.

The housing 170 may be integrated with the heat sink 110. The housing 170 may be made of a metal material having high heat conduction properties to dissipate heat generated by the light emitting module 120. Alternatively, the housing 170 may be configured separately from the heat sink 110. In this case, the housing 170 may be mounted to the heat sink 110. In particular, where the housing 170 and heat sink 110 are configured separately from each other, the housing 170 may be inserted into a cavity (insertion portion) provided at a lower end of the heat sink 110. The housing 170 may be inserted up to a region near the mounting block 115, in order to reduce the distance to the light emitting module 120, for example, to reduce the length of electrical connections and to reduce the overall size of the lighting apparatus 100. The housing 170 may be made of a heat and electrical insulating material.

The electronic module 160 may include various elements, for example, an AC/DC converter, a transformer to adjust voltage levels, a controller for networked control of the lighting apparatus, or another appropriate electrical elements.

The heat sink 110 may be made of a metal material to rapidly dissipate heat generated from the light emitting module 120. A plurality of heat radiation fins 113 may be provided at the heat sink 110 to increase the contact surface of the heat sink 110 with ambient air.

The light emitting module 120 may be classified into a top view type light emitting module, in which light is mainly emitted toward the central region 140*a* of the bulb 140, or a side view type light emitting module, in which light is mainly emitted toward the side region 140*b* of the bulb 140. Simply for ease of description, the light emitting module 120 of a side view type is described herein, however, it should be appreciated that the present disclosure is not limited thereto.

The light emitting module 120 may include one or more first substrates 121, which are mounted to one or more side surfaces 117 of the mounting block 115, and at least one LED 122 mounted on the first substrate 121. The mounting block 115 may have an N-polygonal column shape having N side surfaces (N≥3). In this case, the lighting apparatus 100 may include a plurality of light emitting modules 120 mounted to respective side surfaces 117 of the mounting block 115. The mounting block may also be a column having a round side surface.

The light emitting module 120 may also include a second substrate 123 mounted on the top surface 116 of the mounting block 115 and provided with a connector 124 electrically connected to the electronic module 160. The first and second substrates 121 and 123 may be electrically coupled to each other.

A protrusion 121*a* may be provided at the first substrate 121, and a groove (not designated by a reference numeral) corresponding to the protrusion 121*a* may be provided at the second substrate 123. The protrusion 121*a* may fit inside the groove. While the protrusion 121*a* is disclosed as being provided at the first substrate 121 and the groove, in which the protrusion 121*a* is fitted, is disclosed as being provided at the second substrate 123, a reverse arrangement may be implemented. The first and the one or more second substrates 121, 123 may be positioned perpendicular with respect to each other, as shown in FIG. 3.

Power is supplied from the electronic module 160 to the connector 124, and is then supplied to the LED 122 on the first substrate 121 by sequentially passing through the connector 124 and electrical connections at the groove of the second substrate 123 and the protrusion 121*a* of the first substrate 121. For example, the first and second substrates 121 and 123 may be printed circuit boards (PCBs) having traces or tracks for making electrical connections. The PCB may have multiple layers. The track on the second substrate 123 may run from the connector 124 to the groove and the track on the first substrate 121 may run from the LEDs 122 to the protrusion 121*a*. When the protrusion 121*a* is mated with the corresponding groove, the tracks may contact each other to electrically connect power to the LEDs 122. The junction between the two tracks may be soldered. Moreover, the mounting block 115 may have a through hole 118 through which a cable (or wire) may extend to electrically connect the connector 123 of the second substrate 124 and the electronic module 160.

The mounting block 115 may be made of a metal material having high thermal conductivity in order to rapidly transfer heat generated from the light emitting module 120 to the heat sink 110. The mounting block 115 and the heat sink 110 may be formed as a single structure. The mounting block 115 may be formed to be the top portion of the heat sink 110. The lighting apparatus 100 may further include a heat conduction pad P interposed between the mounting block 115 and the light emitting module 120 to improve dissipation of heat.

Figure 4:
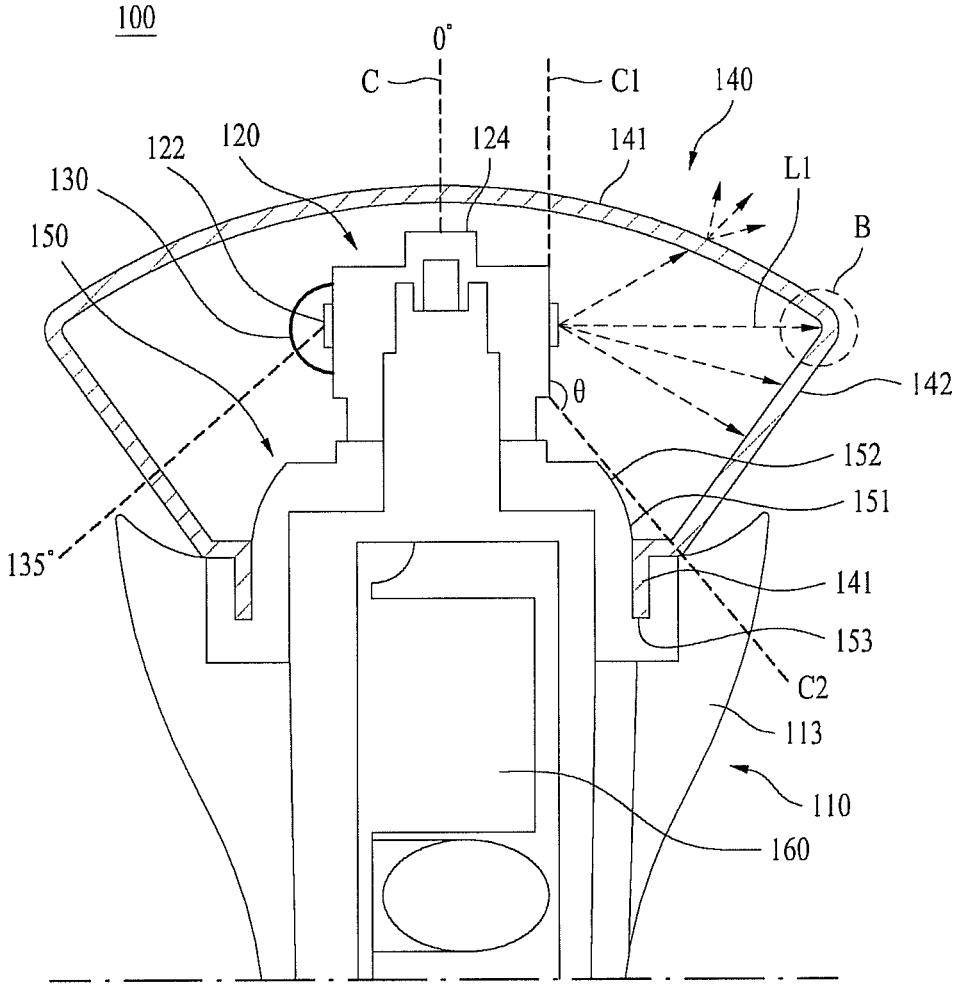
FIG. 4 is a sectional view of a lighting apparatus according to one embodiment.
Figure 5:
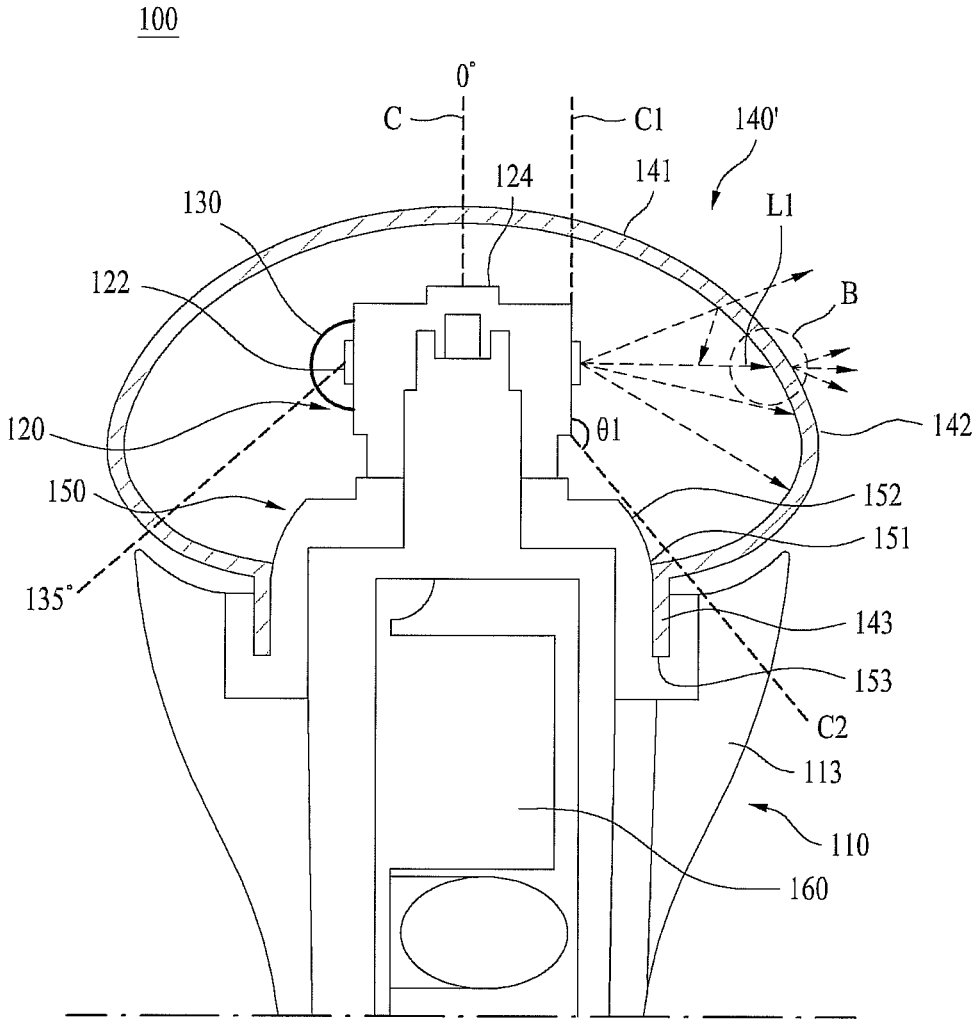
FIG. 5 is a sectional view of a lighting apparatus according to another embodiment.
Figure 6:
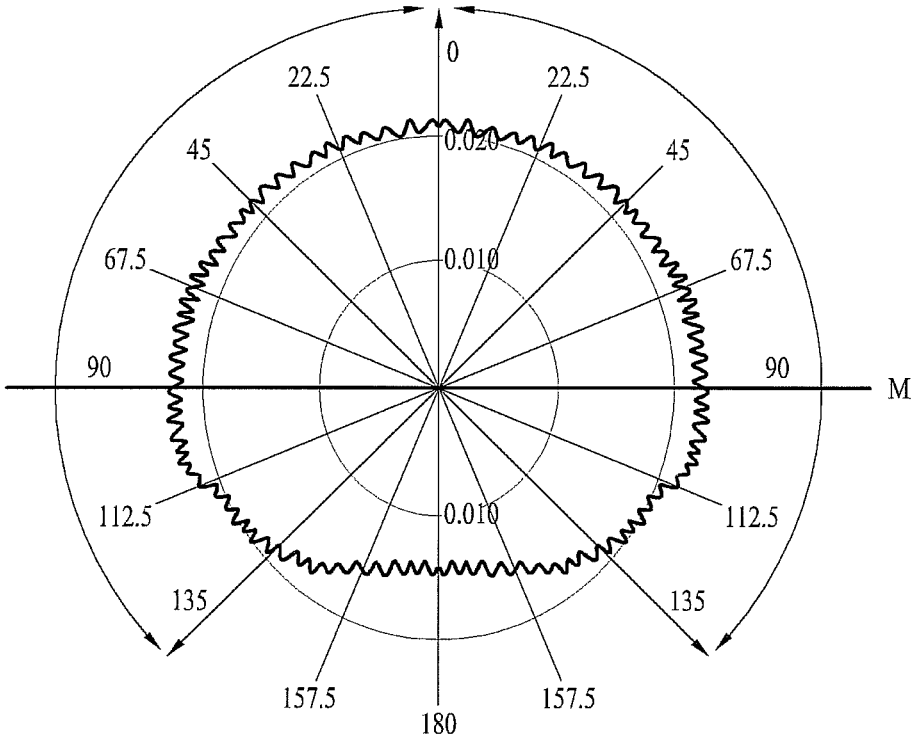
FIG. 6 is a graph illustrating light distribution characteristics of the lighting apparatus according to one embodiment.

FIG. 4 is a sectional view of a lighting apparatus according to one embodiment. FIG. 5 is a sectional view of a lighting apparatus according to another embodiment. FIG. 6 is a graph illustrating light distribution characteristics of the lighting apparatus according to one embodiment.

The lighting apparatus 100 may be an omni-directional light source that provides omni-directional light distribution. Omni-directional light distribution as referred to herein may include distribution of light having a minimum light velocity (luminous flux) of 5% or more at a light distribution angle of 135° or more, and having an average light velocity difference (luminous flux deviation) of 20% or less at a predetermined light distribution angle in a range of 0° to 135°. In other words, luminous intensity (candelas) of the lighting apparatus 100 may be evenly distributed in a zone or angular range within 0° to 135°, measured from an optical center of the lighting apparatus. This light distribution zone may be vertically axially symmetrical. At least 5% of total flux (lumens) may be emitted in the zone within 135° to 180°. Moreover, luminous intensity at any angle within the 0° to 135° zone may not differ from the mean luminous intensity for the entire zone by more than 20%.

As previously discussed, the LED 122 of the light emitting module 120 may exhibit a high degree of directionally characterized by a narrow light distribution angle (for example, about 120°). Furthermore, where the light emitting module 120 is of a side view type, light emitted at a certain light distribution angle may be reflected by the first reflector 150 away from the lower end region 140*c* of the bulb 140, resulting in a large amount of light being transmitted through the central region 140*a* or side region 140*b* of the bulb 140. This may result in uneven distribution of light. In this case, it may be difficult to satisfy the requirements of the above-described omni-directional light distribution.

Where the light emitting module 120 is of the side view type, as described above, the reflector 150 may include the inclined surface 152, which is downwardly inclined from the side surfaces 117 of the mounting block 115 toward the heat sink 110. The inclined surface 152 may prevent the reflector 150 from interfering with light emitted from the LED 122 at a predetermined light distribution angle.

The inclined surface 152 of the lower reflector 150 may have a downward inclination of 120° to 140° with reference to the side surfaces 117 of the mounting block 115. The angle of incline may be determined by taking into consideration the light distribution angle of the LED (e.g., 120°). The angle of incline may be determined to be within the above angular range, taking into consideration the distance between the lower reflector 150 and the LED 122 as well as the size of the lower reflector 150. Moreover, the inclined surface 152 may be linear or may be curved.

The disclosed lighting apparatus of FIGS. 4 and 5 may satisfy the requirements for the above-described omni-directional light distribution because light emitted from the LED 122 may be radiated through the side region 140*b* and lower end region 140*c* of the bulb 140, using the light emitting module 120, which may be of the side view type, and the reflector 150, which has the inclined surface 152.

Meanwhile, in FIG. 4, reference character "C" designates a central axis of the bulb 140, "C1" represents a line that extends from one side surface of the mounting block 115, "C2" represents a line that extends from the inclined surface 152 of the reflector 150, and "θ" represents an angle of line C2 with respect to line C1. The inclination θ may range from 120 to 140°.

In this embodiment, in order to obtain enhanced light distribution characteristics and/or scattering characteristics as light passes through the bulb 140, the bulb 140 may include a first diffusion portion 141 provided at a top portion of the bulb 140, and a second diffusion portion 142 provided at a lower portion of the bulb 140. The first and second diffusion portions 141 and 142 may have different curvatures. For example, the second diffusion portion 142 may have a diameter linearly reduced as the second diffusion portion 142 extends toward the heat sink 110 and away from the LED 122.

In order to obtain enhanced scattering characteristics, the LED 122 may be disposed at a boundary B between the first and second diffusion portions 141 and 142. For example, the LED 122 may be arranged such that a light emission axis L1 thereof, along which light is emitted in a maximum amount, passes through the boundary B between the first and second diffusion portions 141 and 142.

In one embodiment, a lens 180 may be provided to cover the LED 122 to improve light distribution. The lens 130 may be provided over each LED 122 or may cover a plurality of LEDs 122 on a substrate. The lens 130 may be mounted to the substrate.

In another embodiment, referring again to FIGS. 1 and 5, the enclosure 140' may have a round or globe shape. For example, the central region 140*a*, the side region 140*b* and the lower end region 140*c* may be curved gradually, as illustrated in FIG. 1. Each of the regions 140*a*, 140*b*, 140*c* may have different curvatures. The lower end region 140*c* may be curved to extend along the top surface of the heat sink fins 113 to emit or diffuse light from the LEDs 122 toward the lower region of the lighting apparatus 100. Regions 140*a* and 140*b* may correspond to a first diffusion portion 141 and region 140*c* may correspond to a second diffusion portion 142.

Referring again to FIGS. 1 to 3, the reflector 150 may be configured to reduce heat transfer from the light emitting module 120 and the heat sink 110 to the bulb 140. The heat sink 110 may include a mounting portion 114 (mounting surface), on which the mounting block 115 for mounting the light emitting module 20 is mounted. The mounting portion 114 may be provided at the top portion of the heat sink 110. The heat sink 110 may also include a recess 112 for receiving the mounting end 143 of the bulb 140.

The heat sink 110 may further include a cavity formed in the interior of the heat sink 110 and opened to a lower end of the heat sink 110 to receive the housing 170. The recess 112 may be provided in a space defined between the mounting portion 114 and the heat radiation fins 113. The mounting portion 114 may be upwardly protruded from the heat sink 110 to a height higher than the heat radiation fins 113.

Meanwhile, the light emitting module 120 may generate a large amount of heat during operation of the lighting apparatus 100. The heat may be dissipated through the heat sink 110. If the bulb 140 is mounted in a state of direct contact with the heat sink 110, heat generated from the light emitting module 120 may be transferred to the bulb 140 via the heat sink 110. As a result, the bulb 140 may warp or otherwise be damaged due to the high temperatures.

In order to prevent or limit heat transfer to the bulb 140, the lower reflector 150 may be disposed between the heat sink 110 and the bulb 140 in order to reduce the amount of heat transferred from the heat sink 110 to the bulb 140. For example, the reflector 150 may provide spacing between the heat sink 110 and bulb 140 to prevent the heat sink 110 and bulb 140 from directly contacting each other. The reflector 150 may include an opening 154 on the top surface which corresponds to the shape of the mounting block 115 such that the reflector 150 may be placed on an upper surface of the heat sink 110 to surround the mounting block 115.

The reflector 150 may have a structure for providing a space between the heat sink 110 and bulb 140. For example, the reflector 150 may include a ring portion 151 (an inclined surface) for surrounding at least a part of the mounting portion 114, and a fitting groove portion 153 (recess) formed around a circumferential surface of the ring portion 151 to receive the mounting end 143 of the bulb 140. The inclined surface 152 of the reflector 150 may be formed along a circumference of the upper end of the ring portion 151, as illustrated in FIG. 3. The ring portion 151 and the fitting groove portion 153 may be formed to correspond to the mounting portion 114 and the recess 112 formed on the upper portion of the heat sink 110.

Meanwhile, if the reflector 150 is fastened to the heat sink 110 by fasteners made of a metal material in a state of being fitted in the recess 112, heat may be transferred from the heat sink 110 to the mounting end 143 of the bulb 140 via the fasteners. To this end, the reflector 150 may be mounted over the mounting portion 114 without fasteners.

The bulb 140 may be attached to the reflector 150 by friction fitting using protrusions. A protrusion may be provided on the mounting end 143 (or flange) of the bulb 140. A groove configured to mate with the protrusion may be formed on fitting groove portion 153 of the reflector 150. Accordingly, the bulb 140 may be coupled to the heat sink 110 without using separate fasteners (e.g., screws, bolts, clips). It should be appreciated that the configuration may be reversed, such that the protrusion is provided on the lower reflector 150 and the groove is provided on the bulb 140.

Moreover, the protrusion and groove may extend circumferentially around the respective surfaces of the bulb and lower reflector 150 as a single structure. Alternatively, one or more pairs of protrusion and groove may be placed at prescribed distances along the flange 143 and the fitting groove portion 153.

In one embodiment, the flange 143 may be formed as a plurality of tabs rather than having a ring shape. The use of tabs rather than a ring shaped flange 143 may reduce heat transfer to the bulb 143 by reducing the contact surface of the bulb 140. In this case, one or more of the plurality of tabs may include the protrusion or groove to fit a corresponding protrusion or groove on the reflector 150.

The reflector 150 may be made of a material having high heat resistance because it is fastened directly to the heat sink 110. On the other hand, the lower reflector 150 may be made of a material having low thermal conductivity in order to reduce the amount of heat transferred from the heat sink 110 to the bulb 140.

In one embodiment, a thermal insulator may be provided in the fitting groove portion 153 to further prevent heat transfer to the bulb 140. The insulator may be formed of a pliable material or a rigid material formed to correspond to the fitting groove portion 153. The insulator may have lower thermal conductivity than the bulb 140. The thermal insulator may also be a coating, tape, or another appropriate type of material formed on the flange 143 of the bulb 140.

In one embodiment, the flange 143 of the bulb may be formed of a different material than regions 140*a*, 140*b*, and 140*c*. For example, the flange 143 may be formed on a material having a lower thermal conductivity than the remaining portions of the bulb 140. Also, the reflector 150 may be made of a material having high reflectivity in order to reflect light emitted from the light emitting module 120 over the omni-directional region of the bulb 140. A reflective layer may be provided on the surface of the reflector 150, such as a coating or film, to provide the desired light characteristics.

The heat sink 110 may further include an inclined portion 114*a* circumferentially formed at an upper end of the mounting portion 114. The inclined portion 114*a* may have the same inclination as the inclined surface 152 of the reflector 150. The inclined portion 114*a* may mate to the inclined surface 152 when the heat sink 110 and the reflector 150 are fastened to each other.

For example, the upper portion of the heat sink 110 may be formed to have a prescribed shape that corresponds to a prescribed shape of the bottom surface of the reflector 150. The upper portion of the heat sink 110 may have a column shape that protrudes vertically from the body of the heat sink 110. Here, one or more of the corresponding surfaces of the reflector 150 and the upper portion of the heat sink 110 such that the reflector 150 may be placed to cover the upper portion of the heat sink 110. For example, the inclined surfaces 114*a* of the heat sink 110 may correspond to the inclined surfaces 151 and/or 152 of the reflector 150.

The surfaces of the recess 112 may be formed to correspond to the bottom side surfaces of the recess 153 on the reflector 150. The recess 153 of the reflector 150 may be placed in a corresponding recess 112 formed on the upper portion of the heat sink 110. The corresponding surfaces of recess 153 and recess 112 may contact each other when the reflector 150 is mounted on the heat sink 110. In one embodiment, a predetermined gap may be formed between the surfaces of recess 153 and recess 112 such that the reflector 150 does not contact the heat sink 110 at the recess. In another embodiment, a thermal insulator may be placed between the surfaces of recess 153 and recess 112 in order to prevent or limit heat transfer to the reflector 150 and the bulb 140. Here, the reflector 150 may be fixed to the heat sink 110 by friction fitting or may be secured using one or more screws 155.

Referring to FIG. 6, the lighting apparatus as described herein may provide omni-directional light distribution as previously discussed. In the graph, 0° on the polar coordinate corresponds to the central axis C of the lighting apparatus 100 (e.g., the top or lens side), and 180° corresponds to the direction of the heat sink (e.g., the bottom side). The line M at 90° corresponds to the vertical position of the optical center (e.g., the height of the LEDs). As illustrated, luminous intensity of the lighting apparatus 100 may be evenly distributed in the zone or angular range within 0° to 135°, measured from an optical center of the lighting apparatus.

As apparent from the above description, the lighting apparatus as embodied and broadly described herein may radiate light emitted from the LED in a uniform amount over the omni-directional region of the bulb. The lighting apparatus may reduce the amount of heat transferred from the heat sink to the bulb. In addition, the lighting apparatus may achieve a reduction in the number of constituent elements, a reduction in manufacturing costs, and ease of mass production.

As embodied and broadly described herein, a lighting apparatus may include a heat sink including a mounting block having a top surface and a plurality of side surfaces, a bulb disposed on the heat sink while surrounding the mounting block such that a central region of the bulb corresponds to a top surface of the mounting block, a light emitting module for emitting light toward a side region of the bulb, the light emitting module including a first substrate mounted to one side surface of the mounting block, and an LED) mounted on the first substrate, an electronic module electrically connected to the light emitting module, a first reflection member disposed on the heat sink, the first reflection member including an inclined surface, which is downwardly inclined from the side surfaces of the mounting block toward the heat sink to prevent the first reflection member from interfering with light emitted from the LED at a predetermined light distribution angle, and a second reflection member disposed on a top portion of the mounting block, to reflect light emitted from the LED toward the side region of the bulb and a lower end region of the bulb.

The inclined surface of the first reflection member may have a downward inclination of 120 to 140° with reference to the side surfaces of the mounting block. The second reflection member may include a cap portion surrounding the top portion of the mounting block, and a reflection portion extending from an outer circumferential surface of the cap portion. The reflection portion may have a ring shape. The reflection portion may be upwardly inclined from the side surfaces of the mounting block toward the central region of the bulb.

The bulb may include a first diffusion portion provided at a top portion of the bulb, and a second diffusion portion provided at a lower portion of the bulb. The first and second diffusion portions may have different curvatures.

The LED may be arranged to emit light toward a boundary between the first and second diffusion portions. The LED may be arranged such that a light emission axis thereof, along which light is emitted in a maximum amount, passes through the boundary between the first and second diffusion portions. The second diffusion portion may have a diameter linearly reduced as the second diffusion portion extends away from the LED.

The light emitting module may further include a second substrate disposed on the top surface of the mounting block and provided with a connector electrically connected to the electronic module. The second reflection member may include a cap portion surrounding the connector and the second substrate, and a reflection portion extending from an outer circumferential surface of the cap portion. The reflection portion may be upwardly inclined from the side surfaces of the mounting block toward the central region of the bulb.

One of the first and second substrates may be provided with a protrusion, and the other of the first and second substrates may be provided with a groove, in which the protrusion is fitted. The protrusion and the groove may be electrically connected.

The mounting block may further have a through hole, through which a cable for electrically connecting the connector and the electronic module extends. The heat sink may further include a mounting portion, on which the mounting block is mounted, the mounting portion being provided at a top portion of the heat sink, a recess provided at the top portion of the heat sink, to receive the first reflection member, and a cavity formed in the interior of the heat sink and opened to a lower end of the heat sink, to receive the housing.

The first reflection member may further include a ring portion for surrounding at least a part of the mounting portion, and a fitting groove portion formed around a circumferential surface of the ring portion, to receive the mounting end of the bulb. The first reflection member may further include an inclined surface circumferentially formed along an upper end of the ring portion.

One of the bulb and the fitting groove portion may be provided with a protrusion, and the other of the bulb and the fitting groove portion may be provided with a groove, in which the protrusion is fitted. The first reflection member may be fastened to the mounting portion via the ring portion. The lighting apparatus may further include a heat conduction pad interposed between the light emitting module and the mounting block.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting apparatus comprising:

a heat sink;

a mounting block provided over the heat sink having a top surface and a plurality of side surfaces;

at least one light emitting module provided on at least one side surface of the mounting block, the light emitting module including a substrate and a light emitting diode (LED) mounted on the substrate;

a reflector provided over the heat sink, adjacent to a lower end of the mounting block, to reflect light from the LED;

an enclosure provided over the heat sink to surround the mounting block to diffuse the light;

an electronic module electrically connected to the light emitting module;

a housing attached to the heat sink and formed to house the electronic module; and a power socket mounted to the housing to provide power to the electronic module, wherein the LED is positioned such that the light axis of the LED is directed to a side region of the bulb and light emitted from the LED is distributed in a region a first prescribed angle with respect to the light axis, wherein the reflector includes an inclined surface that is inclined at a second prescribed angle away from the light axis, and wherein the enclosure includes a first diffusion region provided at an upper region of the enclosure and a second diffusion region provided at a lower region of the enclosure, the first and second diffusion regions having different curvatures.

2. The lighting apparatus of claim 1, wherein the second prescribed angle is greater than or equal to the first prescribed angle.

3. The lighting apparatus of claim 2, wherein the inclined surface does not extend beyond an imaginary line from the LED to an intersection between the enclosure and the heat sink.

4. The lighting apparatus of claim 1, wherein an angular range of the region is 135° with respect to a central vertical axis of the heat sink.

5. The lighting apparatus of claim 1, wherein a height of the heat sink is at least one half of a total height of the lighting apparatus.

6. The lighting apparatus of claim 1, wherein the inclined surface of the reflector is inclined more than 90° with respect to a central vertical axis of the heat sink.

7. The lighting apparatus of claim 1, wherein the inclined surface of the reflector is inclined between 120° to 140° with respect to the side surfaces of the mounting block.

8. The lighting apparatus of claim 1, wherein the LED is arranged to emit light toward a boundary between the first and second diffusion regions.

9. The lighting apparatus of claim 8, wherein the LED is arranged such that a light axis of the LED passes through the boundary between the first and second diffusion regions.

10. The lighting apparatus of claim 8, wherein a diameter of the enclosure at the second diffusion region linearly decreases toward the heat sink.

11. The lighting apparatus of claim 1, wherein the light emitting module further includes a second substrate provided over the top surface of the mounting block that has a connector which is electrically connected to the electronic module.

12. The lighting apparatus according to claim 11, wherein a protrusion is formed to laterally extend from at least one of the first or second substrates, and a groove is formed to laterally extend into the other of the first or second substrates to mate with the protrusion, and wherein the protrusion and the groove are electrically connected to each other.

13. The lighting apparatus of claim 11, wherein a hole is formed through the mounting block and a cable is placed through the hole to electrically connect the connector to the electronic module.

14. The lighting apparatus of claim 1, wherein the heat sink includes a mounting surface on which the mounting block is mounted, the mounting surface being provided at a top portion of the heat sink, a recess provided at the top portion of the heat sink that receives reflector, and a cavity foimed in the interior of the heat sink and opened to a lower end of the heat sink to receive the housing.

15. The lighting apparatus of claim 14, wherein the reflector includes a ring portion that surrounds at least a portion of the mounting surface, and a fitting groove foinied around a circumferential surface of the ring portion to receive the mounting end of the bulb.

16. The lighting apparatus of claim 15, wherein the reflector remove extra space further includes an inclined surface circumferentially formed along an upper end of the ring portion.

17. The lighting apparatus of claim 15, wherein a protrusion is formed on at least one of the bulb or the fitting groove, and a groove is formed on the other of the bulb or the fitting groove to fit the protrusion.

18. The lighting apparatus of claim 15, wherein the reflector is fastened to the mounting surface via the ring portion.

19. The lighting apparatus of claim 1, further including a heat conduction pad interposed between the light emitting module and the mounting block.

20. A lighting apparatus comprising:

a heat sink;

a mounting block provided over the heat sink having a top surface and a plurality of side surfaces;

at least one light emitting module provided on at least one side surface of the mounting block, the light emitting module including a substrate and a light emitting diode (LED) mounted on the substrate;

a reflector provided over the heat sink, adjacent to a lower end of the mounting block, to reflect light from the LED;

an enclosure provided over the heat sink to surround the mounting block to diffuse the light;

an electronic module electrically connected to the light emitting module;

a housing attached to the heat sink and formed to house the electronic module; and a power socket mounted to the housing to provide power to the electronic module, wherein the LED is positioned such that the light axis of the LED is directed to a side region of the bulb and light emitted from the LED is distributed in a region a first prescribed angle with respect to the light axis, wherein the reflector includes an inclined surface that is inclined at a second prescribed angle away from the light axis, and wherein the heat sink includes a mounting surface on which the mounting block is mounted, the mounting surface being provided at a top portion of the heat sink, and a recess provided at the top portion of the heat sink that receives the reflector.

* * * * *